US009593652B2

(12) United States Patent
Grandi

(10) Patent No.: US 9,593,652 B2
(45) Date of Patent: Mar. 14, 2017

(54) FLUID INJECTOR AND METHOD AND APPARATUS FOR OPERATING THE FLUID INJECTOR

(75) Inventor: Mauro Grandi, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 1118 days.

(21) Appl. No.: 13/382,020

(22) PCT Filed: Jun. 7, 2010

(86) PCT No.: PCT/EP2010/057879
§ 371 (c)(1),
(2), (4) Date: Jan. 3, 2012

(87) PCT Pub. No.: WO2011/000663
PCT Pub. Date: Jan. 6, 2011

(65) Prior Publication Data

US 2012/0104112 A1 May 3, 2012

(30) Foreign Application Priority Data

Jul. 2, 2009 (EP) ..... 09008684

(51) Int. Cl.
*F02M 51/00* (2006.01)
*F02M 51/06* (2006.01)
*F02D 41/20* (2006.01)

(52) U.S. Cl.
CPC ..... *F02M 51/0617* (2013.01); *F02D 41/20* (2013.01); *F02M 51/0621* (2013.01); *F02D 2041/2079* (2013.01)

(58) Field of Classification Search
CPC ..... F02D 41/20; F02D 2041/2041; F02M 51/0617; F02M 51/0621
(Continued)

(56) References Cited

U.S. PATENT DOCUMENTS 4,974,564 A 12/1990 Laufer ..... 123/506
5,992,391 A * 11/1999 Yamakado et al. ..... 123/490
(Continued)

FOREIGN PATENT DOCUMENTS

CN 101025137 A 8/2007 ..... F02M 51/06
EP 1522699 A2 4/2005 ..... F02D 41/20
(Continued)

OTHER PUBLICATIONS

Chinese Office Action, Application No. 201080029734.2, 9 pages, May 13, 2013.
(Continued)

*Primary Examiner* — Arthur O Hall
*Assistant Examiner* — Viet Le
(74) *Attorney, Agent, or Firm* — Slayden Grubert Beard PLLC

(57) ABSTRACT

A fluid injector has a longitudinal axis (L) and a valve needle (12), which is axially moveable and operable to prevent a fluid injection in a closing position and to permit the fluid injection in further positions. The fluid injector also has an armature (14) which is mechanically coupled to the valve needle (12). Furthermore, the fluid injector has a solenoid assembly (30) which has at least a first and second coil (34, 36) and which is operable to magnetically actuate the armature (14) via an electrical signal (V) applied to at least one predetermined assortment of the at least two coils (34, 36).

6 Claims, 2 Drawing Sheets

(58) Field of Classification Search
USPC ..... 239/533.1, 533.2, 585.1, 584, 585.2, 11; 251/129.04
See application file for complete search history.

(56) References Cited

U.S. PATENT DOCUMENTS

| | | | | |
|---|---|---|---|---|
| 7,070,128 | B2 | 7/2006 | Delas | 239/585.5 |
| 7,095,599 | B2 | 8/2006 | Maekawa et al. | 361/152 |
| 2002/0166541 | A1 | 11/2002 | Yamakado et al. | 123/490 |
| 2003/0116657 | A1 | 6/2003 | Nakayama et al. | 239/585.1 |
| 2007/0194152 | A1 | 8/2007 | Abe et al. | 239/585.2 |

FOREIGN PATENT DOCUMENTS

| | | | | |
|---|---|---|---|---|
| EP | 1522699 | A3 | 4/2005 | F02D 41/20 |
| JP | 59224464 | A | 12/1984 | F02M 51/06 |
| KR | 20040029046 | A | 4/2004 | F02M 51/06 |
| KR | 100638939 | B1 | 10/2006 | F02D 41/30 |
| WO | 88/08080 | A1 | 5/1995 | F02D 1/02 |

OTHER PUBLICATIONS

International PCT Search Report and Written Opinion, PCT/EP2010/057879, 9 pages, Oct. 4, 2010.
Korean Office Action, Application No. 2012-7002836, 5 pages, May 13, 2016.
Korean Notice of Allowance, Application No. 1020127002836, 3 pages, Nov. 4, 2016.

* cited by examiner

FLUID INJECTOR AND METHOD AND APPARATUS FOR OPERATING THE FLUID INJECTOR

CROSS-REFERENCE TO RELATED APPLICATIONS

This application is a U.S. National Stage Application of International Application No. PCT/EP2010/057879 filed Jun. 7, 2010, which designates the United States of America, and claims priority to EP Application No. 09008684.4 filed Jul. 2, 2009, the contents of which are hereby incorporated by reference in their entirety.

TECHNICAL FIELD

The present disclosure concerns fluid injectors and method and apparatus for operating a fluid injector.

BACKGROUND

Fluid injectors are in widespread use, in particular for internal combustion engines where they may be arranged in order to dose fluid into an intake manifold of the internal combustion engine or directly into the combustion chamber of a cylinder of the internal combustion engine.

In order to enhance the combustion process in view of the creation of unwanted emissions, the respective fluid injector may be suited to dose fluids under very high pressures. The pressures may be in case of a gasoline engine, for example, in the range of up to 200 bar and in the case of diesel engines in the range of up to 2000 bar.

SUMMARY

According to various embodiments, a fluid injector and a method and an apparatus which facilitates a reliable and efficient fluid injection can be provided.

According to an embodiment, a fluid injector may comprise a longitudinal axis, a valve needle, being axially moveable and being operable to prevent a fluid injection in a closing position and to permit the fluid injection in further positions, an armature being mechanically coupled to the valve needle, and a solenoid assembly comprising at least a first and second coil and being operable to magnetically actuate the armature via an electrical signal applied to at least one predetermined assortment of the at least two coils.

According to a further embodiment, the first and second coil can be electrically coupled in series. According to a further embodiment, the fluid injector may comprise at least a first, second and third connector, wherein the first connector is electrically coupled to a common contact of the first and second coil, wherein the second connector is electrically coupled to a further contact of the second coil, wherein the third connector is electrically coupled to a further contact of the first coil.

According to another embodiment, in a method for operating a fluid injector as described above, a pressure is determined representing a fluid pressure within the fluid injector, one of predetermined assortments of the at least two coils is selected dependent on the determined pressure, and the electrical signal is applied to the selected assortment.

According to a further embodiment of the method, the electrical signal can be applied to the first coil, if the determined pressure is equal or less than a predetermined pressure threshold, wherein the electrical signal is applied to the first and second coil, if the determined pressure exceeds the predetermined pressure threshold. According to a further embodiment of the method, the electrical signal can be dependent on the determined pressure.

According to another embodiment, an apparatus for operating a fluid injector as described above, may be configured to determine a pressure representing a fluid pressure within the fluid injector, to select one of predetermined assortments of the at least two coils dependent on the determined pressure, and to apply the electrical signal to the selected assortment.

BRIEF DESCRIPTION OF THE DRAWINGS

Exemplary embodiments are explained in the following with the aid of schematic drawings. These are as follows.

DETAILED DESCRIPTION

Figure 1:
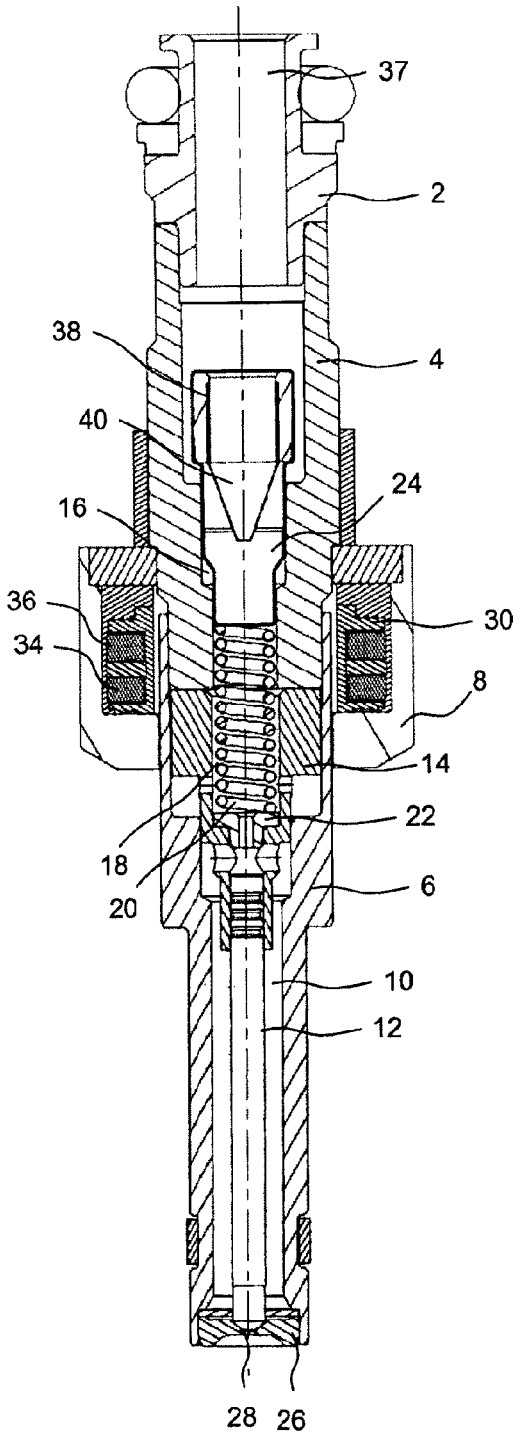
FIG. 1 a fluid injector.

According to various embodiments of a first aspect, a fluid injector may comprise a longitudinal axis and a valve needle, which is axially moveable and operable to prevent a fluid injection in a closing position and to permit the fluid injection in further positions. The fluid injector also comprises an armature which is mechanically coupled to the valve needle. The fluid injector further comprises a solenoid assembly which comprises at least a first and second coil and which is operable to magnetically actuate the armature via an electrical signal applied to at least one predetermined assortment of the at least two coils. This enables a very flexible adjustment of the fluid injection to the current operating conditions of the fluid injector. Furthermore, this allows a short response time of the fluid injector. The fluid injector is preferably suited for dosing fluid, in particular fuel, into an internal combustion engine.

In particular the amount of predetermined assortments correlates to the number of coils within the solenoid assembly and is in particular at least two. The solenoid assembly may also comprise more than two coils. The fluid, e.g. diesel or gasoline, is supplied under high pressure. A high fluid pressure within the fluid injector typically counteracts against a fast actuation time of the fluid injector. Applying the electrical signal on a first predetermined assortment comprising more than one coil contributes to increasing the solenoid inductance and the magnetic force acting on the armature. This permits the fluid injection in a fast manner. On the other hand, if the fluid pressure within the fluid injector is relatively low the electrical signal may be applied to a second predetermined assortment comprising less coils than the first assortment. This reduces e.g. ohmic drops due to reduced resistance and contributes to ensuring an efficient operation of the fluid injector.

Also each coil of the solenoid assembly may be applied with the electrical signal independently from each other allowing a flexible adjustment of the fluid injection.

In an embodiment according to the first aspect, the first and second coil are electrically coupled in series. This allows a flexible actuation of the fluid injector. When the solenoid assembly comprises more than two coils all coils are electrically coupled in series.

In a further embodiment according to the first aspect, the fluid injector comprises at least a first, second and third connector. The first connector is electrically coupled to a common contact of the first and second coil. The second connector is electrically coupled to a further contact of the second coil. The third connector is electrically coupled to a further contact of the first coil. This allows an actuation of valve needle via the first coil, if the fluid pressure is low and an actuation of the valve needle via the first and second coil, if the fluid pressure is high. The amount of connectors in particular correlates to the number of coils of the solenoid assembly.

According to further embodiments of a second and third aspect, in a method and a corresponding apparatus for operating the fluid injector, a pressure is determined representing a fluid pressure within the fluid injector. One of predetermined assortments of the at least two coils is selected dependent on the determined pressure. The electrical signal is applied to the selected assortment. This allows a reliable and efficient operation of the fluid injector. For example the first assortment may be applied with the electrical signal, if the determined pressure is high and the second assortment may be applied with the electrical signal, if the determined pressure is low.

In a further embodiment according to the second and third aspect, the electrical signal is applied to the first coil, if the determined pressure is equal or less than a predetermined pressure threshold. The electrical signal is applied to the first and second coil, if the determined pressure exceeds the predetermined pressure threshold. The first and second coil may represent the first assortment and the first coil may represent the second assortment.

In a further embodiment according to the second and third aspect, the electrical signal is dependent on the determined pressure. The electrical signal is preferably a voltage applied to the solenoid assembly. Preferably a value of the electrical signal is increased, if the pressure is high and the value of the electrical signal is decreased, if the pressure is low. This contributes to an efficient operation of the fluid injector.

Elements of the same design and function that appear in different illustrations are identified by the same reference character.

A fluid injector (FIG. 1) which is in particular suited for dosing fluid, in particular fuel, into an internal combustion engine comprises a fitting adapter 2 being designed to mechanically and hydraulically couple the fluid injector to a fluid reservoir, such as a fuel rail. The fluid injector has a longitudinal axis L and further comprises an inlet tube 4, a valve body 6 and a housing 8.

A recess 10 in the valve body 6 is provided which takes in a valve needle 12 and preferably a part of an armature 14. The valve needle 12 is mechanically coupled to the armature 14. A first recess 16 of the inlet tube 4 is provided which hydraulically communicates with a second recess 18 of the armature 14. A spring 20 is arranged in the first recess 16 of the inlet tube 4 and/or the second recess 18 of the armature 14. Preferably, the spring 20 rests on a spring seat being formed by an anti-bounce disk 22. The spring 20 is in this way mechanically coupled to the valve needle 12. An adjusting tube 24 is provided in the first recess 16 of the inlet tube 4. The adjusting tube 24 forms the further seat for the spring 20 and may during the manufacturing process of the fluid injector be axially moved in order to preload the spring 20 in a desired way.

In a closing position of the fluid injector, the valve needle 12 sealingly rests on a seat 26 and prevents in this way a fluid flow through at least one injection nozzle 28. The injection nozzle 28 may, for example, be an injection hole, it may, however, also be of some other type suitable for dosing fluid. The seat 26 may be made as one part with the valve body 6 or may also be made as a separate part. A fluid injection is permitted, if the valve needle 12 is in further positions.

The fluid injector comprises a solenoid assembly 30 with a first and second coil 34, 36. The first and second coil 34, 36 are preferably overmolded. The solenoid assembly 30 may comprise more than two coils.

A fluid inlet 37 is provided in the fitting adapter 2 which communicates with a filter 38. The adjusting tube 24 is designed for the fluid to flow through it towards the injection nozzle 28. For this purpose, the anti-bounce disk 22 is provided with an appropriate recess which communicates hydraulically with the recess of the armature 14. The adjusting tube 24 is provided with a damper 40 for dampening the fluid flow. The damper 40 comprises at least one orifice, through which the fluid must flow when flowing from the fluid inlet 37 of the fluid injector to the at least one injection nozzle 28.

Figure 2:
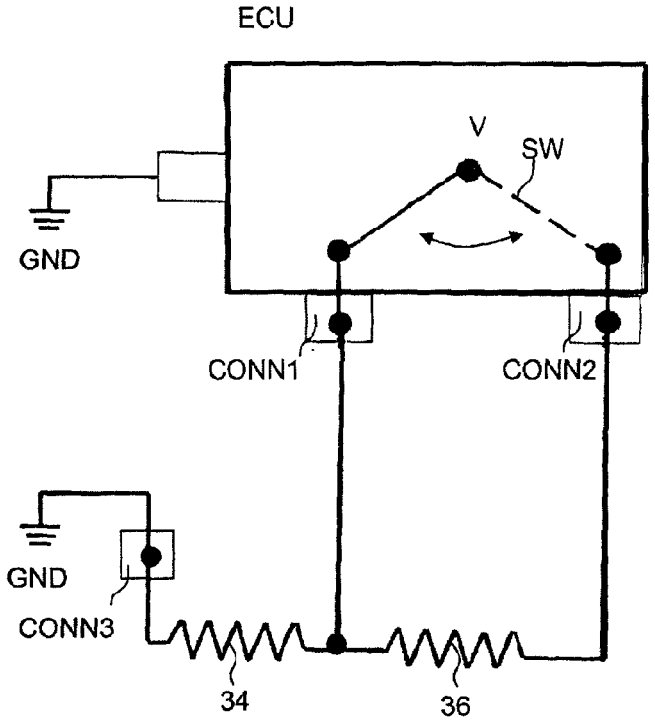
FIG. 2 control unit.

The fluid injector also comprises a connector unit for electrically connecting the solenoid assembly 30, in particular the first and second coil 34, 36, externally. The first and second coil 34, 36 are electrically coupled in series. If more than two coils are available, all coils are electrically coupled in series. The connector unit comprises a first, second and third connector CONN1, CONN2, CONN3 (FIG. 2). If the solenoid assembly 30 comprises more than two coils, the connector unit also comprises more than three connectors. The first connector CONN1 is electrically coupled to a common contact of the first and second coil 34, 36. The second connector CONN2 is electrically coupled to a further contact of the second coil 36 and a further contact of the first coil 34 is electrically coupled to the third connector CONN3.

The housing 8 and the armature 14 form a magnetic circuit. The magnetic circuit guides a magnetic flux of a magnetic field being generated by the solenoid assembly 30.

FIG. 2 depicts a control unit ECU with a switching element SW. The control unit is preferably an engine control unit and applicable to execute a method for operating the fluid injector. In particular the control unit ECU is an apparatus for operating the fluid injector.

The control unit ECU is electrically coupled to the first connector CONN1 via a first end of the switching element SW and is further electrically coupled to the second connector CONN2 via a second end of the switching element SW. The control unit ECU is further applicable to electrically couple the fluid injector to the reference potential GND via the third connector CONN3.

Figure 3:
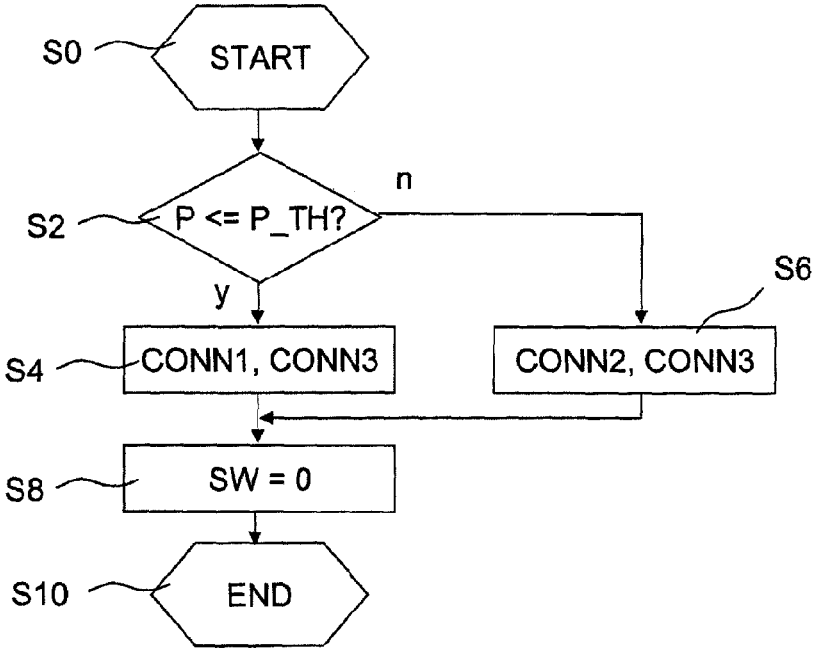
FIG. 3 flow chart.

The fluid injection is executed by starting the method for operating the fluid injector in step S0 (FIG. 3). In step S2 a pressure P is compared with a predetermined pressure threshold P_TH, e.g. 80 bar. The pressure P represents a fluid pressure within the fluid injector, e.g. 30 to 220 bar in case of a gasoline combustion engine. If the pressure P is less or equal than the pressure threshold P_TH step S4 is executed, wherein the third connector CONN3 is electrically coupled to the reference potential GND. Furthermore, the switching element SW is actuated in such a way, that the electrical signal V is applied to the first coil 34 via the first connector CONN1. The first coil 34 represents one of predetermined assortments of the first and second coil 34, 36. The electrical signal V is preferably a supply voltage. This forms the magnetic circuit acting on the armature 14 to axially move the valve needle 12 permitting the fluid injection.

If the pressure P exceeds the pressure threshold P_TH step S6 is executed, wherein the third connector CONN3 is electrically coupled to the reference potential GND. Furthermore, the switching element SW is actuated in such a way, that the electrical signal V is applied to the first and second coil 34, 36 via the second connector CONN2. The first and second coil 34, 36 represent a further one of predetermined assortments. Compared to step S4 this results in an increased inductance of the solenoid assembly 30. A high pressure P typically counteracts against a fast actuation of the valve needle 12. Increasing the inductance of the solenoid assembly increases typically the magnetic force acting on the armature 14 to axially move the valve needle 12. This contributes to a fast actuation of the valve needle 12 for injecting fluid.

Additionally, the value of the electrical signal V is increased in step S6 compared to the value of the electrical signal V supplied in step S4. This results in an increased current supplied to the corresponding coils. In step S8 the fluid injection is stopped or limited after a predetermined time period by changing the electrical signal V correspondingly. Alternatively, the switching element SW is set into a neutral position, wherein the switching element SW is neither coupled to the first connector CONN1 nor to the second connector CONN2. In step S10 the method ends. Alternatively, the method restarts in step S2 for executing a subsequent fluid injection.

What is claimed is:

1. A method for operating a fluid injector with a longitudinal axis, a valve needle, an armature being mechanically coupled to the valve needle, and a solenoid assembly comprising at least first and second coils arranged in series and being operable to magnetically actuate the armature via an electrical signal applied to at least one predetermined assortment of the at least two coils, using a single switch to select among predetermined assortments, the method comprising:

determining a pressure representing a fluid pressure within the fluid injector, selecting one of the predetermined assortments of the at least two coils dependent on the determined pressure, wherein the predetermined assortments comprise (i) only the first coil, and (ii) both coils in series, and applying the electrical signal using a first switch position of the single switch to the predetermined assortment comprising only the first coil if the determined pressure is less than or equal to a predetermined pressure threshold for the fluid injector, and switching the electrical signal using a second switch position of the single switch to run through the predetermined assortment comprising both coils in series if the determined pressure exceeds the predetermined pressure threshold for the fluid injector.

2. The method according to claim 1, wherein the electrical signal is dependent on the determined pressure.

3. An apparatus for operating a fluid injector with a longitudinal axis, comprising:

a valve needle, a control unit, an armature being mechanically coupled to the valve needle, and a solenoid assembly comprising at least first and second coils coupled in series and a single switch, the solenoid operable to magnetically actuate the armature via an electrical signal applied to multiple predetermined assortments of the at least two coils, the control unit being configured to:

receive a pressure signal representing a fluid pressure within the fluid injector, select one of the predetermined assortments of the at least two coils dependent on the received pressure signal, wherein the assortments comprise (i) only the first coil, and (ii) both coils, and apply the electrical signal using the switch to the predetermined assortment comprising only the first coil if the received pressure signal represents a fluid pressure within the fluid injector that is less than or equal to a predetermined pressure threshold for the fluid injector, and applying the electrical signal to the predetermined assortment comprising both coils if the received pressure signal represents a fluid pressure within the fluid injector that exceeds the predetermined pressure threshold for the fluid injector.

4. The method according to claim 3, wherein the fluid injector further comprises at least a first, second and third connector, wherein the first connector is electrically coupled to a common contact of the first and second coil, wherein the second connector is electrically coupled to a further contact of the second coil, wherein the third connector is electrically coupled to a further contact of the first coil.

5. The apparatus according to claim 3, wherein the fluid injector further comprises at least a first, second and third connector, wherein the first connector is electrically coupled to a common contact of the first and second coils, wherein the second connector is electrically coupled to a further contact of the second coil, wherein the third connector is electrically coupled to a further contact of the first coil.

6. The apparatus according to claim 3, wherein the electrical signal is dependent on the determined pressure.

* * * * *